US005300867A

United States Patent [19]

Brade et al.

[11] Patent Number: 5,300,867

[45] Date of Patent: Apr. 5, 1994

[54] ELECTRIC DRIVE ARRANGEMENT FOR A CORD WINDING AND DEWINDING WINCH

[75] Inventors: Claus B. Brade; Jesper Darum, both of Copenhagen; Mads P. Frium, Allerod, all of Denmark

[73] Assignee: V. Kann Rasmussen Industri A/S, Soborg, Denmark

[21] Appl. No.: 901,190

[22] Filed: Jun. 19, 1992

[30] Foreign Application Priority Data

Jun. 25, 1991 [DK] Denmark ..... 1245/91
Jul. 5, 1991 [DK] Denmark ..... 1311/91

[51] Int. Cl.[5] ..... E06B 9/70; E06B 9/60; E05F 15/10

[52] U.S. Cl. ..... 318/468; 160/310; 160/313

[58] Field of Search ..... 318/264, 265, 266, 286, 318/362, 466, 467, 468, 469, 470, 480; 49/25; 160/1, 66, 98, 108, 133, 138, 141, 144, 192, 238, DIG. 10, DIG. 17, 245, 291, 292, 293.1, 294, 298, 299, 305, 309, 310, 313, 331

[56] References Cited

U.S. PATENT DOCUMENTS 3,561,520 2/1971 Gill ..... 160/331
4,055,023 10/1977 Gatland et al. ..... 49/28
4,064,648 12/1977 Cary ..... 49/332 X
4,429,265 1/1984 Barnard ..... 318/475
4,917,167 4/1990 Voss et al. ..... 160/84.1
4,931,708 6/1990 Johnsen ..... 318/466
5,105,131 4/1992 Schap ..... 318/282
5,195,569 3/1993 Peterson et al. ..... 160/84.1

FOREIGN PATENT DOCUMENTS 420989 1/1935 United Kingdom .

*Primary Examiner*—Bentsu Ro
*Attorney, Agent, or Firm*—Lane, Aitken & McCann

[57] ABSTRACT

In an electric drive arrangement for a cord winding and dewinding winch (22), in particular for cord-operated screening and opening/closing devices for windows and doors, in which the operating cord (4) is connected with said device for moving it in one direction when winding up the cord on said winch (22), the latter being turned in one direction by means of an electric motor (12), while movement in the other direction is effected by a spring force acting on the device while dewinding the cord from the winch (22), the latter being turned by the electric motor (12) in the opposite direction, the winding and dewinding winch (22) for the cord is combined into a drive unit with the electric motor (12) and connected thereto by a transmission device, which is influenced by a braking force, means being provided for stopping the electric motor in response to suspension of the tension in the cord (4) caused by the movement in said other direction effected by the spring force, when dewinding the cord, said stopping means including a detector (18,19) influenced by the rotation of the winch (22).

9 Claims, 1 Drawing Sheet

ELECTRIC DRIVE ARRANGEMENT FOR A CORD WINDING AND DEWINDING WINCH

Figure 1:
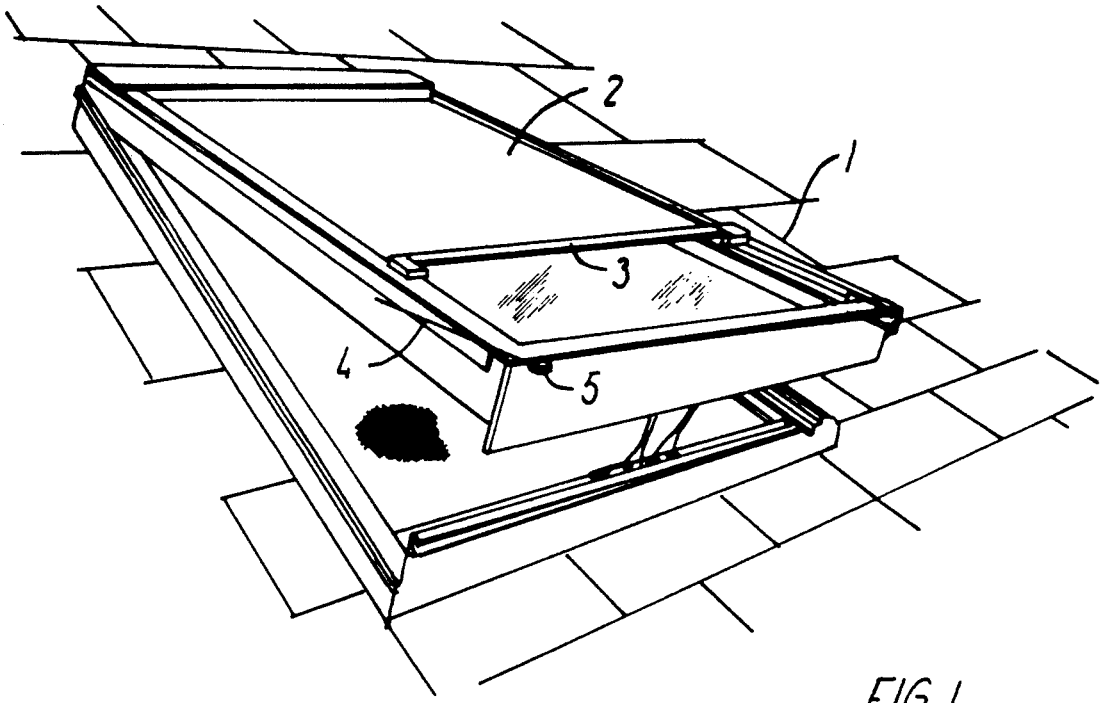

The present invention relates to an electric drive arrangement for a cord winding and dewinding winch, in particular for cord-operated screening and opening/-closing devices for windows and doors, in which the operating cord is connected with said device for moving it in one direction when winding up the cord on said winch, the latter being turned in one direction by means of an electric motor, while movement in the other direction is effected by a spring force acting on the device while dewinding the cord from the winch, the latter being turned by the electric motor in the opposite direction, a stopping device for the movement in said one direction being provided for disrupting the cord winding movement.

In connection with roof windows light or heat reducing screening devices such as a rollable sunblind cloth, a web, or the like, are often used, the rolling up of which, as stated above, is normally carried out on a roller placed at the top of the window, said roller having a built in spring motor, which in addition to functioning as a drive during the rolling up also keeps the inclined cloth tight in arbitrary positions between the top and the bottom positions. The rolling out is effected by an operating cord, which from a fixed point at the bottom of the window is passed through a hollow bottom rail at the lower end of the cloth and over one or more pulleys to the inside of the window sash, whereby the sunblind is operable from the inside both in case of a closed and an open window.

The securing of the cloth in intermediary positions between the completely rolled up position and the completely unrolled position is thus effected by means of the operating cord, the cloth having, as mentioned above, to be constantly influenced by the spring force in the rolling up direction from the spring motor in order to be kept tight, as is known per se.

Screening devices of this type have up till now usually been manually operated, but electric drive arrangements of the above type are known, which when used in connection with screening devices function in such a way that unrolling of the cloth is effected against the spring power coming from the spring-driven motor in the roller, the unrolling movement being disrupted when the cloth reaches the bottom position, whereby the motor is stopped as a consequence of the motor power exceeding a predetermined value. The spring-driven motor used in connection with such screening devices is normally so powerful that it is able to roll up the cloth by itself, when the operating cord slackens at rotation of the motor against the rolling up direction. To prevent the motor from running on and dewinding a possible remainder of cord on the winch and subsequently starting the winding of the cord in the opposite direction, the cloth being again rolled out, it is necessary to provide an end stop for the winding movement in the upper position of the cloth. This may be carried out by causing the bottom rail of the cloth in the top position to activate a coupler or a sensor, which either directly or via a controlling device switches off the motor, but for this purpose it is necessary to interfere with the window installation in order to place a wiring from such a sensor to the electric motor, which in order to attain the simplest possible cord path has to be positioned close to the bottom position of the cloth.

Without being limited to use in connection with screening devices of the above type, the object of the invention is to provide a simplified, electric drive arrangement, which requires no complicated wiring and which may be installed on existing, manually operated installations.

Beyond use in connection with sunblinds and similar screening devices it is a further object of a drive arrangement according to the invention to be applicable in connection with opening/closing devices for doors and windows, in which the movement in one direction is effected by means of an operating cord, while the movement in the opposite direction is effected by means of a spring force.

In order to meet these objects an electric drive arrangement according to the invention is characterized in that the winding and dewinding winch for the cord is combined into a drive unit with the electric motor and connected thereto by a transmission device, which is influenced by a braking force, means being provided for stopping the electric motor in response to suspension of the tension in the cord caused by the movement in said other direction effected by the spring force, when dewinding the cord, said stopping means including a detector influenced by the rotation of the winch.

The electric motor with accompanying transmission device and winding and dewinding winch may be constructed as a compact electrical unit, which may be positioned in the place most convenient with respect to the cord threading.

Further advantages and details of an electric drive arrangement according to the invention will appear from the subclaims.

Figure 2:
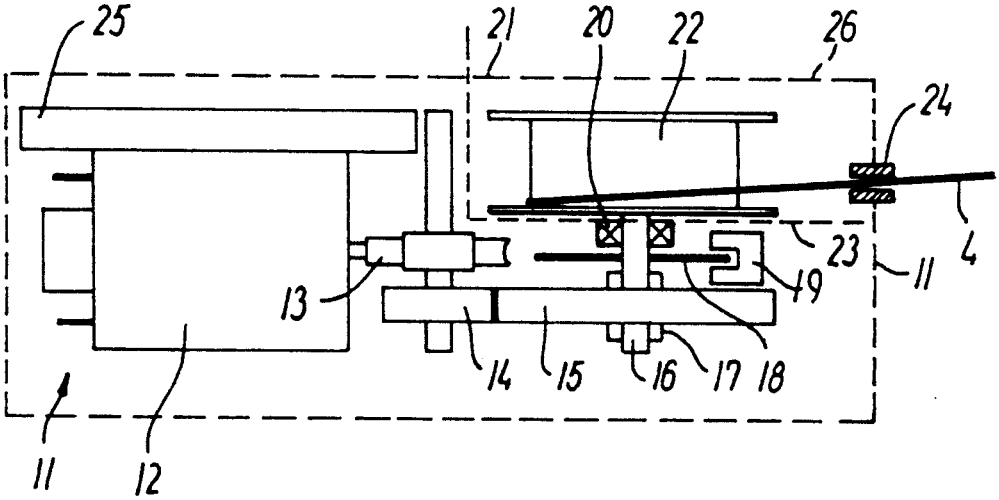

The invention will be explained in detail in the following with reference to the schematic drawing, in which FIG. 1 as an example of the use of an electric drive arrangement according to the invention shows a top-hinged roof window with a cord-operated exterior sunblind cloth, and FIG. 2 schematically shows an embodiment of a drive arrangement according to the invention.

The top-hinged roof window 1 shown in FIG. 1 has an exterior sunblind with a cloth 2, through the bottom rail 3 of which an operating cord 4 is passed, said cord starting at a fixed point 5 at the bottom of the window sash in one of its corners and being guided through a pulley arrangement at the opposite bottom corner of the window sash through the sash to its interior side.

In the embodiment shown in FIG. 2 the electric drive arrangement 11 comprises an electric motor 12, the transmission shaft of which through a worm 13 acts on a gear transmission with gear wheels 14 and 15. The gear wheel is through a free wheeling hub 17 connected with a shaft 16 rigidly connected with a cord winding and dewinding winch 22 for the winding and dewinding of the operating cord 4.

The shaft 16 is led through a bore in a wall 23 of a shielding housing 21 containing the whole drive arrangement 11 with the electric motor 12 and the gear transmission 13–15. A sealing 20 around the shaft 16 at the through-bore through the wall 23 partly serves as a sealing preventing dust and water from penetrating into the housing 11, partly as a friction element for acting on the shaft 16 with a braking power.

On the shaft 16 a tachometer disc 18 is mounted for influencing a photo-electric sensor 19, which through a wiring (not shown) may act on a switching off device (not shown) in the control circuit 25 for the motor 12.

To ensure a controlled winding and dewinding of the operating cord 4 on the winch 22, the cord 4 is passed through a bushing 24 in one of the walls of a housing 26 around the winch 22.

The winding of the cord 4 on the winch 12 in connection with the rolling out of the sunblind 2 is effected by activation of the motor 12 for rotation in one direction. The operating cord 4 is thereby influenced by a rolling out power, which may overcome the spring force acting on the sunblind 2. When the bottom rail 3 of the sunblind during the rolling out movement reaches a mechanical end stop at the bottom of the window sash, the winch 12 stops and consequently the tachometer disc 18 makes the sensor 19 produce a control signal for the switching off device in the control circuit 25, the motor power being thereby switched off.

When rolling up the sunblind 2 by means of the spring force from the spring motor built into the roller of the sunblind, the motor 12 is activated for rotation in the opposite direction to allow dewinding of the cord 4 from the winch 22. The spring motor is so powerful that during the rolling up movement of the sunblind a tension is created in the operating cord 4 during the dewinding from the winch 22. When the bottom rail 3 of the sunblind reaches the top position, the tension in the operating cord 4 will however cease. To bring the motor 12 to a halt before the rest of the cord on the winch 22 is dewound, the winch 22 is stopped by the braking power produced by the sealing and friction element 20, the winch 22 being simultaneously disengaged from the motor 12 on account of the free wheeling in the hub 17 of the gear wheel 15. When the winch 22 stops, the tachometer disc 18 influences the photoelectric sensor 19, which produces a control signal for the switching off device in the control circuit 25, the motor power being switched off.

To ensure that the power to the motor is also switched off in case the tachometer 18 stops in an unfortunate position, in which the sensor 19 is supplied with "false" pulses, the control circuit 25 is adapted to switch off the motor power when the sensor 19 supplies pulses at a frequency variating from the frequency range of the pulses during normal operating conditions.

A similar frequency detection can be used to stop the motor and thereby the winch without any need for a free wheeling device by utilizing the frequency reduction occurring due to a reduced rotational speed of the winch and thereby the tachometer disc, when the tension in the cord ceases and the winch is no longer influenced by the spring force.

As mentioned above the use of the drive arrangement according to the invention is not limited to the embodiment shown in the drawing of a cord-operated screening device. Another important field of application is for use in connection with cord/spring force-operated opening and closing devices for for instance high-placed windows.

We claim:

1. An electric drive arrangement for a cord winding and dewinding winch for a screening or opening/closing device for a window or a door, which screening or opening/closing device is operated by an operating cord connected between said winch and said screening or opening/closing device, wherein the cord-operated screening or opening/closing device for a window or door is biased in a first direction, comprising said winch being connected with an electric motor through a transmission device, said motor and said transmission device being combined with said winch into a single drive unit, said electric motor being reversible and acting on said winch to turn said winch in one direction of rotation for winding up said cord, thereby moving said screening or opening/closing device in a second direction opposite to the first direction, wherein movement of the cord-operated screening or opening/closing device in the first direction unwinds said cord from said winch upon rotation of said electric motor in a direction of rotation opposite to said one direction, first stop means for stopping the movement of said screening or opening/closing device in said second direction and thereby the turning of said winch in said one direction of rotation, second stop means for stopping the movement of said screening or opening/closing device in said first direction, thereby suspending the tension in said cord caused by said biased screening or opening/closing device, brake means providing a braking force acting on said transmission device for stopping turning of said winch in said direction opposite to said one direction in response to said suspension of the tension in said cord, detector means for sensing said stopping of the turning of said winch in either direction of rotation, and a control circuit for said electric motor, said control circuit being connected with said detector means for disconnecting the motor in response to said stopping of the winch; said brake means, said detector means and said control circuit being incorporated in said single drive unit.

2. An electric drive arrangement as claimed in claim 1, wherein said transmission device includes a free wheeling device for disconnecting said winch from said electric motor after stopping the turning of said winch in said direction of rotation opposite to said one direction by said braking force.

3. An electric drive arrangement as claimed in claim 2, wherein said braking means includes a friction element acting on a transmission member arranged between said winch and said free wheeling device.

4. An electric drive arrangement as claimed in claim 3, wherein said transmission member comprises a drive shaft passing through a bore in a housing of said electric motor with associated transmission device, and said friction element comprises a sealing element surrounding said drive shaft at said bore.

5. An electric drive arrangement as claimed in claim 4, wherein said free wheeling device comprises a transmission wheel having a hub in free wheeling engagement with said drive shaft.

6. An electric drive arrangement as claimed in claim 5, wherein said detector means comprises an element corotating with the winch and a sensor influenced by said co-rotating element.

7. An electric drive arrangement as claimed in claim 6, wherein said co-rotating element is a tachometer disc arranged on said drive shaft, and said sensor is a photoelectric sensor arranged in operating relationship with said tachometer disc.

8. An electric drive arrangement as claimed in claim 7, wherein said control circuit further comprises means for disconnecting said electric motor in response to a control signal from said detector means including an electric quantity which is outside a normal operating range.

9. An electric drive arrangement as claimed in claim 8, wherein said electric quantity is the frequency of pulses generated by said detector means.

* * * * *